United States Patent [19]

Labadini et al.

[11] 4,020,383

[45] Apr. 26, 1977

[54] METHOD OF PULSING INCANDESCENT LAMP FILAMENTS

[75] Inventors: William M. Labadini, Salisbury; Edmund M. Passmore, Wilmington; Warren A. Anderson, Danvers, all of Mass.

[73] Assignee: GTE Sylvania Incorporated, Danvers, Mass.

[22] Filed: Dec. 31, 1975

[21] Appl. No.: 645,485

[52] U.S. Cl. ..... 313/344; 313/341

[51] Int. Cl.[2] ..... H01J 1/16; H01J 19/06

[58] Field of Search ..... 313/341, 342, 343, 344

[56] References Cited

UNITED STATES PATENTS

| | | | |
|---|---|---|---|
| 2,225,239 | 12/1940 | Spaeth | 313/344 |
| 2,276,048 | 3/1942 | Laise | 313/344 X |
| 3,206,925 | 12/1942 | Aicher | 313/344 X |
| 2,371,205 | 3/1945 | Zabel | 313/344 X |
| 3,210,589 | 10/1965 | Mason | 313/341 X |

FOREIGN PATENTS OR APPLICATIONS

| | | | |
|---|---|---|---|
| 481,964 | 3/1938 | United Kingdom | 313/344 |

*Primary Examiner*—Saxfield Chatmon, Jr.
*Attorney, Agent, or Firm*—James Theodosopoulos

[57] ABSTRACT

One or more pulses of electrical energy are applied to the tungsten wire filament of an incandescent lamp in order to improve lamp performance.

4 Claims, 1 Drawing Figure

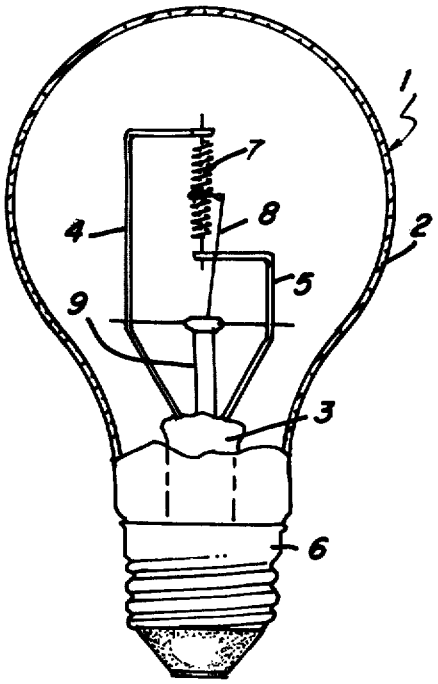
1
2
3
4
5
6
7
8
9

METHOD OF PULSING INCANDESCENT LAMP FILAMENTS

THE INVENTION

This invention concerns incandescent lamps. Such lamps comprise a sealed glass envelope having a coiled tungsten wire filament therein. The filament is generally flashed at the first lightup after sealing in order to convert the tungsten wire into a nonsag recrystallized structure. In the prior art, such flashing was accomplished by the application to the filament of a continuous voltage from a transformer operating off the usual AC line source. A copending application, Docket No. 8363-L, assigned to the same assignee as the instant application, discloses that the filament can be advantageously flashed by application of electrical pulses thereto.

We have discovered that applying one or more electrical pulses to the tungsten filament of an incandescent lamp, even after the filament has been recrystallized, can improve the lamp in several respects. It can increase the average life of the lamp and/or it can increase the average efficiency in terms of lumens per watt for design life, or it can significantly reduce the contact resistance between the lead-in support wires and the filament.

The single FIGURE in the drawing is a plan view of an incandescent lamp of the type relating to this invention. The glass envelope is partly broken to show the filament mount inside.

In one embodiment of an incandescent lamp 1 that can be pulsed in accordance with this invention, glass envelope 2 is sealed at the bottom to the flare of the usual stem press glass mount 3. Lead-in wires 4 and 5 are embedded in glass mount 3 and are in electrical contact with screw base 6 in the usual manner while their inner ends support recrystallized tungsten wire filament 7 within envelope 2. There is a center filament support wire 8 which is embedded in glass post 9 extending from glass mount 3.

Filament 7 can be pulsed by discharging a charged capacitor therethrough, electrical contact to filament 7 being provided by means of base 6. An example of an electrical pulse that has been applied is the discharge from a 33 microfarad capacitor charged to 620 volts. When applied to the filament of a 60-watt 120-volt A19 lamp, the pulse heated the filament to a peak temperature of 2230° C. and required about 20 milliseconds to peak. In the case of a pulse from a 550 microfarad capacitor charged to 320 volts, the pulse peaked at about 40 milliseconds and heated the 60-watt filament to a peak temperature of about 3150° C. For purposes of this invention, the pulse should peak in less than about 100 milliseconds.

An example of the improvement resulting from this invention is as follows. Forty 100-watt 120-volt A19 lamps were tested to determine if they met a test that required that the lamps show electrical continuity at 1 volt, a voltage much lower than their operating voltage of 120 volts. Twenty-one lamps were found which did not show continuity at an applied voltage of 1 volt. Sixteen of these showed continuity when the applied voltage was between 1 and 16 volts; the other five required an applied voltage greater than 16 volts to show continuity. The 21 lamps were each treated by capacitor discharge pulsing, involving one to three pulses from a 33 microfarad capacitor charged to 620 volts. All 21 lamps then showed electrical continuity at the lowest detectable applied voltage of 0.3 volt. Thus, in all the lamps, the electrical pulses eliminated the poor contact problem, which was probably due to tungsten oxide on the surface of the filament wire at the regions where it was clamped within lead-in wire 4 and lead-in wire 5.

In another test, 24 60-watt 120-volt A19 lamps were each subjected to a pulse from a 33 microfarad capacitor charged to 620 volts and were life tested, along with a control group of the same lamps which were not pulsed. The average life of the pulsed lamps was 934 hours, versus 898 hours for the control lamps, which represents an average improvement in life of 4 percent. The average lumens per watt for design life for the pulsed lamps was 13.20 versus 12.93 for the control lamps, an improvement of 2.1 percent for the pulsed lamps. For lamps pulsed with a 550 microfarad capacitor at 320 volts, the improvement in lumens per watt for design life was 1.2 percent.

Although these examples used capacitors to supply the desired electrical pulses, other means may also be used, for example, a pulse transformer or a solid state switching device.

We claim:

1. In an incandescent lamp of the type having a coiled tungsten wire recrystallized filament mounted on lead-in support wires within a glass envelope and having high electrical contact resistance between the filament and the lead-in support wire, the process of reducing electrical contact resistance between the filament and the lead-in support wires by applying a pulse of electrical energy to the recrystallized filament.

2. The proces of claim 1 wherein a plurality of pulses are applied to said filament.

3. The process of claim 1 wherein said pulse of electrical energy comprises the discharge of a capacitor.

4. The process of claim 1 wherein the time to peak of said pulse is less than about 100 milliseconds.

* * * * *